United States Patent [19]

Rahmstorf

[11] 4,190,982

[45] Mar. 4, 1980

[54] ASSEMBLABLE TOY FIGURE

[75] Inventor: Dietmar Rahmstorf, Nuremberg, Fed. Rep. of Germany

[73] Assignee: Messrs. BIG Spielwavenfabrik Dipl.-Ing. Ernst A. Bettag, Fürth, Fed. Rep. of Germany

[21] Appl. No.: 863,221

[22] Filed: Dec. 22, 1977

[30] Foreign Application Priority Data

Jan. 12, 1977 [DE] Fed. Rep. of Germany ..... 2700969

[51] Int. Cl.[2] ..... A63H 3/00

[52] U.S. Cl. ..... 46/161; 46/22

[58] Field of Search ..... 46/22, 161, 173, 162, 46/163

[56] References Cited

U.S. PATENT DOCUMENTS

| | | | |
|---|---|---|---|
| 3,124,901 | 3/1964 | Beebe | 46/161 |
| 3,590,516 | 7/1971 | Dunn | 46/22 |
| 3,740,894 | 6/1973 | Howland et al. | 46/161 |
| 3,874,113 | 4/1975 | Beck | 46/161 |
| 3,938,277 | 2/1976 | Goldfarb et al. | 46/161 |
| 3,946,517 | 3/1976 | Goldfarb et al. | 46/22 |
| 3,995,395 | 12/1976 | Rahmstorf | 46/161 |

*Primary Examiner*—Louis G. Mancene
*Assistant Examiner*—Mickey Yu

[57] ABSTRACT

An assemblable toy figure has a hollow trunk divided into front and rear portions, a head mounted for relative rotation on a locking bar that engages in internal recesses in the trunk portions, and arms and legs respectively pivotable relative to the trunk. The legs are mounted on pins extending from a pivot joint supported from within the trunk and rotatable about a vertical axis relative to the trunk, whereby in the assembled figure the trunk can turn laterally relative to the legs.

12 Claims, 3 Drawing Figures

ASSEMBLABLE TOY FIGURE

BACKGROUND OF THE INVENTION

1. Field of the Invention

The invention concerns an assemblable toy figure including the hollow trunk divided by a vertical transverse plane into a front portion and a rear portion, a head rotatable about a vertical locking bar extending downwardly therefrom and adapted to secure the trunk portions together, and a pair of arms and legs respectively journalled in the trunk for pivoting about a generally horizontal axis, each arm having at its upper end a lateral extension engaging in a respective opening in the trunk through which opening the transverse plane passes, the extensions serving as pivotal axes, and the legs are engaged from below into a recess provided at the front of the trunk to enable pivotal movement of the legs, and the legs for journalling pivot pin constituting their pivotal axes.

2. Description of the Prior Art

In a known toy figure of this type (DT-OS No. 25 06 786=U.S. Pat. No. 3,995,395=GB-PS No. 1 497 013) the arms and legs are each enabled to pivot about a generally horizontal pivotal axis so that therefore the arms can be raised and lowered. Also each leg can be moved separately from the other between a vertical and a horizontal position so that the toy figure can carry out or can be set into running movements or the like. Although therefore this known figure can already make several movements it has nevertheless been found that for certain situations an increased mobility of this figure would be advantageous.

SUMMARY OF THE INVENTION

Accordingly, the underlying task of the invention is so to construct a toy figure of the above-mentioned type that further possibilities of movement of the trunk relative to the legs are provided in order to improve the stimulus to play and to enhance the possibilities of use of the figure, as compared with the known figure.

To solve this task, a toy figure of the above-mentioned kind is proposed according to the invention wherein the bottom of the trunk has a journal opening or recess in which a pivot joint supported at the trunk is journalled for rotation about a vertical axis, which opening or recess accommodates the horizontal pivot axes for the legs, and wherein the legs are mounted on the pivot joint with the aid of pivot pins and in the use position are secured through the side wall of the journal opening or recess.

In the toy figure according to the invention the legs are therefore no longer journalled directly in the trunk but rather are journalled at the pivot joint which is rotatable relative to the trunk. In this way it becomes possible to rotate the trunk relative to the legs, i.e. to carry out lateral bending movements also, which was not hitherto possible with the above-mentioned known figures. In spite of this circumstance, however, the toy figure according to the invention is so constructed that its assembly does not give rise to any particular difficulty since, in comparison with the known figure, the legs need only be mounted first on the pivot joint and then the latter is to be located in the journal opening in the trunk and secured there in any suitable manner.

A very simple securing of the pivot joint in the trunk may be obtained by providing the top of the pivot joint with an extension formed by two-circular shanks which can be resiliently pressed together and each of which carries an external barb-like projection; for the rotatable journalling of the pivot joint, the extension can be snapped into a bore of a horizontal transverse wall in the body that covers the top of the journal recess. In this way, after the legs have been mounted on the pivot joint the latter need only be pressed into the journal recess until the barb-like projections of the extension have snapped in at the transverse wall.

Advantageously, the bore in the transverse wall is coaxial with the locking bar and the pivot joint is secured relative to the trunk by means of the free lower end of the locking bar, because then, when the head with the locking bar are placed in position the latter connects not only the trunk or body portions together but also fixes the pivot joint in the trunk. In this context, the construction may advantageously include a vertical axial bore in the extension of the pivot joint, the diameter of the bore corresponding approximately to the diameter of the free lower end of the locking bar which in the locking position projects into the axial bore. By virtue of the projection of the lower end of the locking bar into the axial bore the shanks of the pivot joint forming the extension are prevented from moving towards each other so that the projections of the extensions cannot come loose from the transverse wall even when a considerable force is exerted on the pivot joint, which might be expected to happen because of the available and observable length of the lever arm due to the length of the legs.

The interconnection of the two trunk portions expediently takes place in a manner known per se by providing each of them with at least one connecting web extending into the region of the other trunk portion, all connecting webs having vertical bores which are in alignment when the trunk is assembled together and through which bores the locking bar projects; and that in one of the trunk portions there are two downwardly and convergingly extending plates, spaced internally from the trunk portion, the lower edges of the plates being slightly movable away from each other, overlapping the transverse vertical plane and cooperating with an upwardly flattened shoulder of the locking bar, for locking purposes. It is then advantageous in the figure according to the invention for each trunk portion to be associated with two connecting webs so that two webs engage each other to form respective web pairs, and the lower connecting web of one trunk portion is formed from the transverse wall that journals the pivot joint. In this way the stability of the figure is increased and the moulding of an additional connecting web is obviated.

If in such a construction the connecting web engaging the transverse wall to form the corresponding web pair is provided with a bore with a diameter conforming to the diameter of the bore in the transverse wall which latter bore also accommodates the extension of the snapped-in pivot joint, then one attains a highly satisfactory construction of the transverse wall and the corresponding connecting web and thus also of the two trunk parts. At the same time this construction also provides the advantage that the bore length accommodating the extension of the pivot joint is appreciably enlarged and thus the pivot joint is guided even more reliably.

To simplify manufacture and assembly, it is advantageous to construct the journal recess for the pivot joint piece completely in one trunk part only wherein advantageously the journal recess is at the rear part of the trunk which has a forwardly projecting transverse wall extending over the transverse plane and a peripheral apron forming the side wall of the journal bearing in which apron at the front there is an opening enabling pivotal movement of the legs.

In order to enable the trunk to bend evenly in various rotational positions relative to the pivot joint the journal recess is constructed part-spherically and the upper ends of the legs and the pivot joint have corresponding part-spherical surfaces. In this case naturally the frontal opening enabling pivotal movement of the legs is also wider i.e. extends over a larger peripheral region than is the case for the known toy figure, otherwise only limited bending of the trunk relative to the legs would be possible when the body is turned.

Finally, in order to maximise the contact surface area between the pivot pins and the bore portions accommodating them, it is also within the scope of the invention to secure the pivot pins for the legs to the pivot joint, preferably by being moulded on. A further enlargement of the co-operating surfaces may be achieved by providing the pivot joint with a respective peripheral annular groove for each corresponding pivot pin into which groove engages an annular shoulder enlarging the depth of the bore.

BRIEF DESCRIPTION OF THE DRAWINGS

Other characteristics, details and advantages of the invention will become clear from the following description of a preferred embodiment illustrated in the drawing in which.

DESCRIPTIONS OF THE PREFERRED EMBODIMENTS

Figure 1:
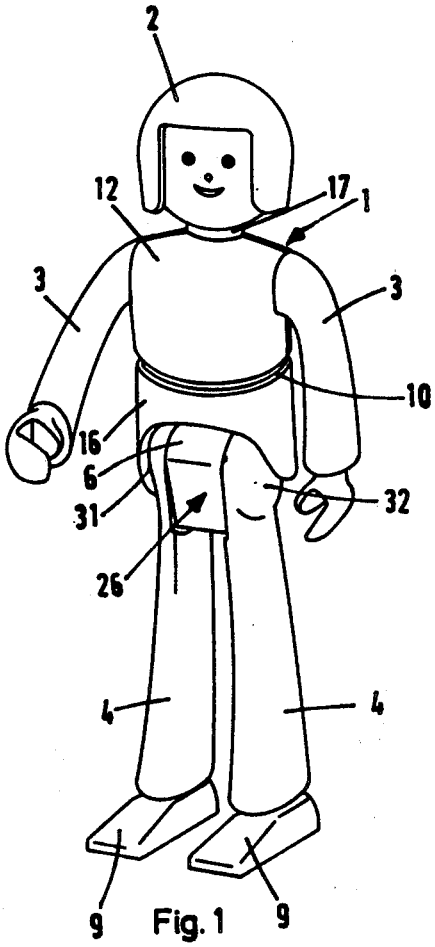
FIG. 1 is a perspective view of the toy figure in an assembled state.

The toy figure illustrated in the drawings consists essentially of a trunk 1, a head 2 with a wig, two arms 3 which are journalled in the trunk 1 for pivoting about a horizontal axis, as well as two legs 4 which engage into the trunk 1 from below and can be pivoted about a horizontal axis 5 between a vertical position and a horizontal sitting position. In order to enable this pivotal movement of the legs 4, the front of the trunk 1 has an opening recess 6. Horizontal pivot pins 7 serve pivotally to journal the legs 4. Feet or shoes 9 are universally rotatably secured by means of balls 8 to the lower ends of the legs 4.

In its upper portion (above the waist line 10) the trunk 1 is similar to the toy figure described in DT-OS No. 25 06 786 (=U.S. Pat. No. 3,995,395=GB-PS No. 1 497 013) and similarly is divided into a rear portion 11 and a front portion 12, with the dividing transverse plane 13 running generally vertically and intersecting the openings 14 into which journal extensions 15 for the pivotal mounting of the arms 3 engage when the figure is assembled together. The lower part of the trunk is provided with a peripheral apron 16 which is aligned with the front and rear trunk portions and includes the frontal opening 6. The mutual locking of the two trunk portions 11, 12 is effected by means of a locking bar 17 arranged beneath the head 2 and serving at the same time for the rotatable journalling of the latter. To this end each trunk portion 11, 12 has a respective upper connecting web 18 provided with a respective vertical bore 19. When the trunk parts 11, 12 are secured together the vertical bores of the connecting webs 18 are aligned, as can be seen from FIG. 3.

Further, the lower end of the front portion 12 of the trunk has a lower connecting web 20 which is larger than the connecting web 18 and which is also provided with a vertical bore 21. Instead of having such a connecting web 20 the rear portion 11 of the trunk is equipped with a base 22 which covers the top of the apron 16 and which also has a vertical bore 23 corresponding to the bore 21. The vertical bore 21 in the lower connecting web 20 and the vertical bore 23 in the base 22 are also aligned when the trunk parts 11, 12 are assembled together (see FIG. 3). For locking, the locking bar 17 engages, on the one hand, through the bores 19 of the connecting webs 18 and, on the other hand, with its free lower end 27 projects into a vertical axial bore 24 of an extension 25 of a pivot joint member 26 serving to journal the legs 4. Two downwardly and convergingly inclined plates 28, which are spaced internally from the rear portion 11 of the trunk and each of which overlaps the transverse plane 13 counteract any attempt to pull the head 2, and the locking bar 17 therewith, upwardly. These plates 28 have lower edges 29 that can be moved slightly away from each other in order to insert the locking bar 17 and at the top they engage a shoulder 30 on the locking bar 17. It is thus achieved that, although the locking bar is relatively easily engageable into the trunk 1, nevertheless the head with the locking bar can only be pulled out again from the trunk with difficulty because then the lower edges 29 of the inclined plates 28 are pushed against each other and thus the force required for pulling out is significantly increased. It is also ensured that after mounting of the head the trunk parts 11, 12 are connected very rigidly with each other.

As already mentioned, the extension 25 into which the lower end 27 of the locking bar 17 engages forms part of the pivot joint 26 which carries the pivot pins 7 for the pivotal mounting of the legs 4. This pivot joint 26 is accommodated in a bearing or journal recess 31 bounded by the apron 16 in the lower portion of the trunk. As is shown best in FIG. 2, since the extension 25 has an essentially circular cross-section the pivot joint 26 can be rotated in the journal recess 31 about a vertical axis that coincides with the axis of the locking bar 17, and naturally the legs 4 secured to the upper ends on the pivot pins 7 can also be rotated therewith. A toy figure is thus obtained the upper body (torso) of which is laterally angularly displaceable relative to the legs 4. Undesired loosening of the legs 4 from the pivot pins 7 is prevented in this figure by the fact that in the region of their projecting portions 32 the legs internally engage the inner wall of the apron 16 and the side wall of the journal recess 31, in the assembled figure.

Figure 3:
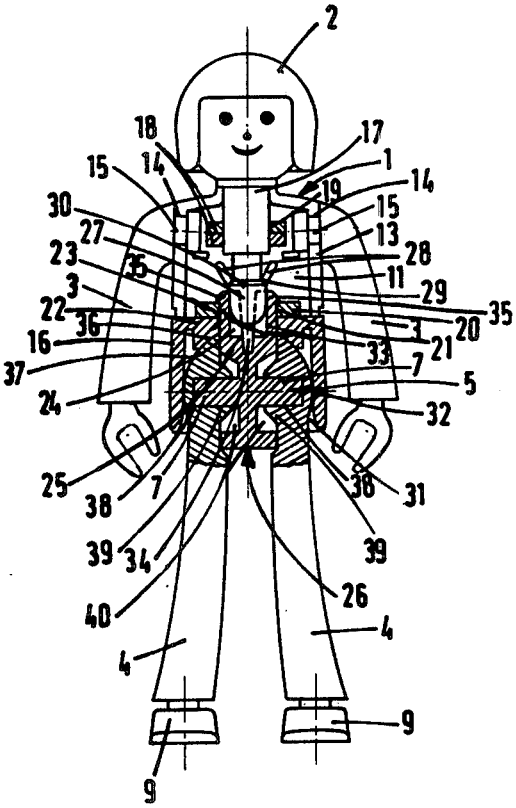
FIG. 3 is a vertical section through the trunk and the upper end of the legs of the toy figure in the vertical transverse plane extending between the trunk parts.
Figure 2:
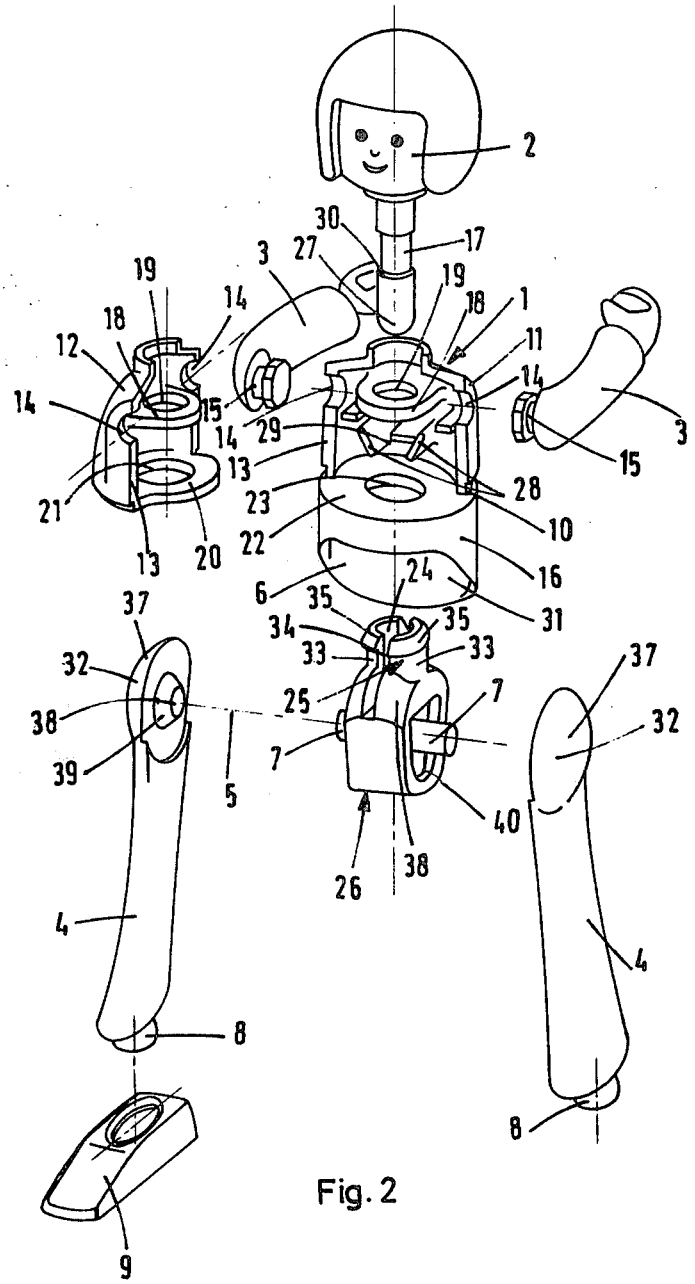
FIG. 2 is also a perspective view, of the parts of the toy figure.

Naturally in such a construction it is important that the pivot joint 26 and thus the legs 4 should not be removable from the trunk 1 too easily and yet, on the other hand, an easy assembly should be possible. To achieve this, the extension 25 of the pivot joint 26 is formed from two resiliently compressible, part-circular shanks 33 (FIG. 2). The two shanks 33 are separated from each other by a vertical slit 34. Additionally they are provided at their free ends with barb-shaped projections 35. In order to snap the extension 25 into the bores 21, 23 of the connecting web 20 and the base 22, respectively, the shanks 33 of the extension 25 may by virtue of the presence of the slit 34 be pressed together, until the projections 35 can be pushed through the bores 21, 23, whereafter the shanks 33 spring apart again until the projections 35 engage over the top of the connecting web 20, as shown in FIG. 3. In order now to make it practically impossible to pull out of the pivot joint 26 and thus the extension 25 downwardly, even when a relatively large force is used which would be possible because of the lever effect that can be produced through the legs, the extension 25 of the pivot joint 26 is additionally locked in the use position by the fact that the lower end 27 of the vertical bar 17 projects into the bore 24 of the extension 25, the bore having a diameter conforming to that of the end of the bar, as shown in FIG. 3, whereby to achieve that the shanks 33 cannot move towards each other and consequently the projections 35 cannot snap out from the connecting web 20.

In order to provide a faultless construction for the journalling of the legs 4 and of the pivot joint 26 in the journal recess 31, the upper side of the journal recess is formed with a part-spherical engagement surface 36 while the upper ends 37 of the legs are correspondingly part-spherically formed. The pivot-joint 26 has part-spherical surfaces 38 at its upper side also, (FIG. 2).

As can be seen clearly from FIGS. 2 and 3 the pivot pins 7 for the legs 4 project only into the bores 38 at the upper end of the legs 4. It is then favourable to make these bores and the corresponding sections of the pivot pins 7 as long as possible to obtain good guidance for the legs 4. To this end, in the illustrated embodiment the legs 4 have an annular shoulders 39 at their upper ends which, as can be seen clearly from FIG. 3, enlarges the depth of the bores 38 for the pivot pins 7. To accommodate the annular shoulders 39 each side of the pivot joint 26 is provided with a respective annular groove 40 surrounding the pivot pins 7.

To assemble the toy figure according to the illustrated embodiment of the procedure is as follows:

First, the arms 3 with the extensions 15 are placed in the region of the openings 14 of the rear part 11 of the trunk. Then the front part 12 is matchingly mounted so that the arms 3 are thus located. Then the legs 4 with the bores 38 are mounted on the pivot pins 7 of the pivot joint 26. Then the extension 25 of the pivot joint 26 carrying the legs 4 is snapped from below into the bores 23 and 21 of the base 22 and the connecting web 20, respectively, with the barb-shaped projections 35 snapping in effect into the wall of the connecting web 20. Next, the locking bar 17 sitting at the head 2 is inserted from above whereby final locking is achieved in the manner shown in FIG. 3. Finally, one then requires only to press either one of the shoes on to the balls 8 of the legs 4, and in given cases, to mount other accessories.

From the preceding description it will be understood that the assembly of the toy figure according to the invention is easily performed and in given cases can be effected by machine. However, disassembly is only possible with great difficulties.

Finally, it should be mentioned that self-evidently the toy figure need not have a trunk 1 which, as shown in the illustrated embodiment, is divided only above the waist-line 10. Rather, an embodiment is conceivable wherein the whole of the trunk is divided by a vertical plane passing through the openings 14 for the arms 3.

I claim:

1. In an assemblable toy figure including a hollow trunk divided along a vertical transverse plane into a front portion and a rear portion, a vertical locking bar, a head mounted for rotation about the vertical locking bar which latter extends downwardly from the head and which serves to non-detachably fasten the trunk portions together, two arms and two legs each of which is mounted in the trunk for pivotal movement about a generally horizontal axis, a respective extension at the upper end of each arm serving as a pivotal axis, lateral openings defined in the trunk and traversed by the said transverse plane, said extensions of the arms engaging on assembly in said openings; an opening defined at the front of the trunk into which the legs engage from below and which enables pivotal movement of the legs, and pivot pins forming pivotal axes for the legs; the improvement comprising a journal recess defined in the bottom part of the trunk; and a pivot joint disposed in said recess means including said locking bar non-detachably supporting said pivot joint in the trunk, said pivot joint being journalled for rotation about a vertical axis, the pivot joint including the horizontal pivotal axis of the legs; and wherein the legs are mounted on the pivot joint by means of the said pivot pins and in the assembled use position are secured by a side wall of the journal recess.

2. A toy figure according to claim 1 wherein an extension member is disposed at the pivot joint, said extension member being constituted by shanks carrying two resiliently compressible part-circular projections having barb-shaped projections on their outer side; a horizontal transverse wall provided in the interior of the trunk to cover the top of the said journal recess and a bore defined in said transverse wall, said extension member being resiliently snappable into said bore.

3. A toy figure according to claim 2 wherein the said bore of the transverse wall is arranged coaxially with the locking bar which has a free lower end, and the pivot joint is secured relative to the trunk by means of the free lower end of the locking bar.

4. A toy figure according to claim 3 wherein the said extension member has a vertical axial bore defined therein the diameter of which corresponds generally to the diameter of the free lower end of the locking bar which in the locking position projects into the said vertical axial bore.

5. A toy figure according to claim 1 wherein each trunk portion has at least one connecting web extending into the region of the other trunk portion, respectively; wherein all connecting webs have vertical bores defined therein, which bores are aligned when the trunk is assembled together and are traversed through by the locking bar; and wherein two downwardly inclined and convergingly arranged plates are spaced inwardly from the said one trunk portion, there being generally horizontal and parallel lower edges on said plates which can be moved slightly away from each other, the said lower edges overlapping the said transverse plane and an upwardly flattened shoulder provided on the locking bar with which said lower edges co-operate for locking.

6. A toy figure according to claim 5 wherein two connecting webs are associated with each trunk portion of which two respectively engage each other to form a web pair, the lower connecting web of one trunk portion being formed by the said transverse wall which in use journals the pivot joint.

7. A toy figure according to claim 6 wherein the connecting web engaging the said transverse wall to form the corresponding web pair has a bore with a diameter corresponding to the diameter of the bore in the transverse wall and which in use accommodates the extension member of the snapped-in pivot joint.

8. A toy figure according to claim 1 wherein the journal recess for the pivot joint is formed exclusively in one of the trunk portions.

9. A toy figure according to claim 8 wherein the journal recess is formed at the rear trunk portion which portion has the said transverse wall projecting forwardly over the said transverse plane and a peripheral apron forms the side wall of the journal recess the front of the journal recess providing the opening that enables pivotal movement of the legs.

10. A toy figure according to claim 1 wherein the journal recess is part-spherical and the upper ends of the legs as well as the pivot joint have correspondingly part-spherical surfaces.

11. A toy figure according to claim 1 wherein the pivot pins for the legs are secured at the pivot joint, preferably by moulding.

12. A toy figure according to claim 11 wherein a respective annular groove is formed in the pivot joint so as to surround the associated pivot pin into which an annular shoulder at the upper end of the associated leg engages in use to increase the depth of the bore for each pivot pin.

* * * * *